US005406260A

United States Patent [19]

Cummings et al.

[11] Patent Number: 5,406,260

[45] Date of Patent: Apr. 11, 1995

[54] NETWORK SECURITY SYSTEM FOR DETECTING REMOVAL OF ELECTRONIC EQUIPMENT

[75] Inventors: Marshall B. Cummings, Ann Arbor, Mich.; Christopher R. Young, Austin, Tex.

[73] Assignee: ChriMar Systems, Inc., Ann Arbor, Mich.

[21] Appl. No.: 992,924

[22] Filed: Dec. 18, 1992

[51] Int. Cl.[6] ..... G08B 21/00

[52] U.S. Cl. ..... 340/568; 340/687

[58] Field of Search ..... 340/568, 571, 572, 652, 340/664, 687

[56] References Cited

U.S. PATENT DOCUMENTS

| | | | |
|---|---|---|---|
| 3,618,065 | 11/1971 | Trip | 340/568 |
| 3,932,857 | 1/1976 | Way et al. | 340/572 |
| 4,654,640 | 3/1987 | Carll et al. | 340/568 |
| 4,686,514 | 8/1987 | Liptak, Jr. et al. | 340/571 |
| 4,736,195 | 4/1988 | McMurtry et al. | 340/568 |
| 4,760,382 | 7/1988 | Faulkner | 340/572 |
| 5,034,723 | 7/1991 | Maman | 340/568 |
| 5,059,948 | 1/1991 | Desmeules | 340/568 |
| 5,066,942 | 11/1991 | Matsuo | 340/568 |
| 5,136,580 | 8/1992 | Videlock et al. | 370/60 |
| 5,231,375 | 7/1993 | Sanders et al. | 340/568 |
| 5,243,328 | 9/1993 | Lee et al. | 340/568 |

FOREIGN PATENT DOCUMENTS

| | | | |
|---|---|---|---|
| 357482 | 3/1990 | European Pat. Off. | 340/568 |
| 4203304 | 8/1992 | Germany | 340/568 |

*Primary Examiner*—John K. Peng
*Assistant Examiner*—Thomas J. Mullen, Jr.
*Attorney, Agent, or Firm*—Harness, Dickey & Pierce

[57] ABSTRACT

A system and method are provided for monitoring the connection of electronic equipment, such as remote computer workstations, to a network via a communication link and detecting the disconnection of such equipment from the network. The system includes current loops internally coupled to protected pieces of equipment so that each piece of associated equipment has an associated current loop. A low current power signal is provided to each of the current loops. A sensor monitors the current flow through each current loop to detect removal of the equipment from the network. Removal of a piece of hardware breaks the current flow through the associated current loop which in turn may activate an alarm. This invention is particularly adapted to be used with an existing 10BaseT communication link or equivalent thereof, employing existing wiring to form the current loops.

19 Claims, 3 Drawing Sheets

NETWORK SECURITY SYSTEM FOR DETECTING REMOVAL OF ELECTRONIC EQUIPMENT

BACKGROUND OF THE INVENTION

1. Technical Field

This invention relates generally to theft protection security systems and, more particularly, to a network security system for detecting the unauthorized removal of remotely located electronic equipment from a network.

2. Discussion

There has been an ever increasing need to provide security for electronic equipment against the unauthorized removal or theft thereof. Computer systems have become a major capital expenditure for users which commonly include businesses, educational institutions and governmental entities, among other users. Advancements in technology have significantly reduced the size and weight of complex computer equipment, thus making expensive computer equipment more easily portable. As a consequence, modern computer equipment is generally more compact and more easily transportable, which further makes it more difficult to secure against the unauthorized removal or theft thereof.

Today, computer network systems are frequently employed to provide efficient computing capabilities throughout a large work area. Existing computer network systems generally include a number of remotely located work stations coupled via a data communication link to a central processing center. For instance, many educational institutions such as universities commonly provide a large number of individual work stations at different locations throughout the university campus so as to allow easy computing access to the computer network system. However, the wide dissemination of such equipment at remote locations has made the equipment an accessible target for computer thieves.

Accordingly, a number of methods have been developed for guarding against the unauthorized removal of electronic equipment. Early methods of protection have included the physical attachment of a security cord to each piece of protected equipment. However, the security cord generally may be cut or physically detached from its secured position and is usually considered to be a non-appealing aesthetic addition to the equipment. Another method of protection includes the attachment of a non-removal tag to the equipment which also requires cooperating sensing devices responsive to the tag which are properly located at exit locations from the premises. However, this approach requires rather expensive sensing devices and is generally not very feasible especially when multiple exit points exist.

Other methods of theft protection have included installing a special electronic card inside each computer machine which responds to polls from an external monitoring station. Upon removal of the machine, the card stops responding to the polling of the central station and an alarm is initiated. Another approach involves mounting a sensing device on or into the machine to detect movement of the machines. These approaches, however, are generally undesirable since they require the incorporation of additional components into each machine.

More recent methods of theft protection have included the sensing of a current loop coupled to the protected equipment. One such method is discussed in U.S. Pat. No. 4,654,640 issued to Carll et al which discloses a theft alarm system for use with a digital signal PBX telephone system. This method includes a plurality of electronic tethers which are connected to individual pieces of protected equipment by way of connectors which in turn are bonded to the surface of the protected equipment. Each tether includes a pair of conductors which are connected together to form a closed current loop via a series resistor and conductive foil which is adhesively bonded to the outside of the equipment. However, this method requires the addition of an externally mounted current loop, and it is conceivable that the current loop may be carefully removed without any detection.

It is therefore desirable to provide for an enhanced network security system which detects unauthorized removal of remotely located pieces of hardware from a network. More particularly, it is desirable to provide for such a security system which feasibly employs separate current loops provided through an existing data communication link to monitor the presence of remotely located computer equipment. In addition, it is desirable to provide for a security network system which may be easily and inexpensively implemented in an existing network system and may not be easily physically removed or detached from tile system without detection.

SUMMARY OF THE INVENTION

In accordance with the teachings of the present invention, a security system is provided for detecting unauthorized removal of electronic equipment from a network. The system includes current loops internally coupled to protected pieces of equipment so that each piece of associated equipment has an associated current loop. A low current power signal is applied to each of the current loops. A detector monitors current flow through each of the current loops so as to detect a drop in current flow which represents removal of equipment from the network. Detection of removal of a piece of equipment may in turn activate an alarm. This invention is particularly adapted to be used in conjunction with a computer network having an existing communication wiring scheme coupling each piece of equipment to the network, and which may be used to form the current loops.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENT

Figure 1:
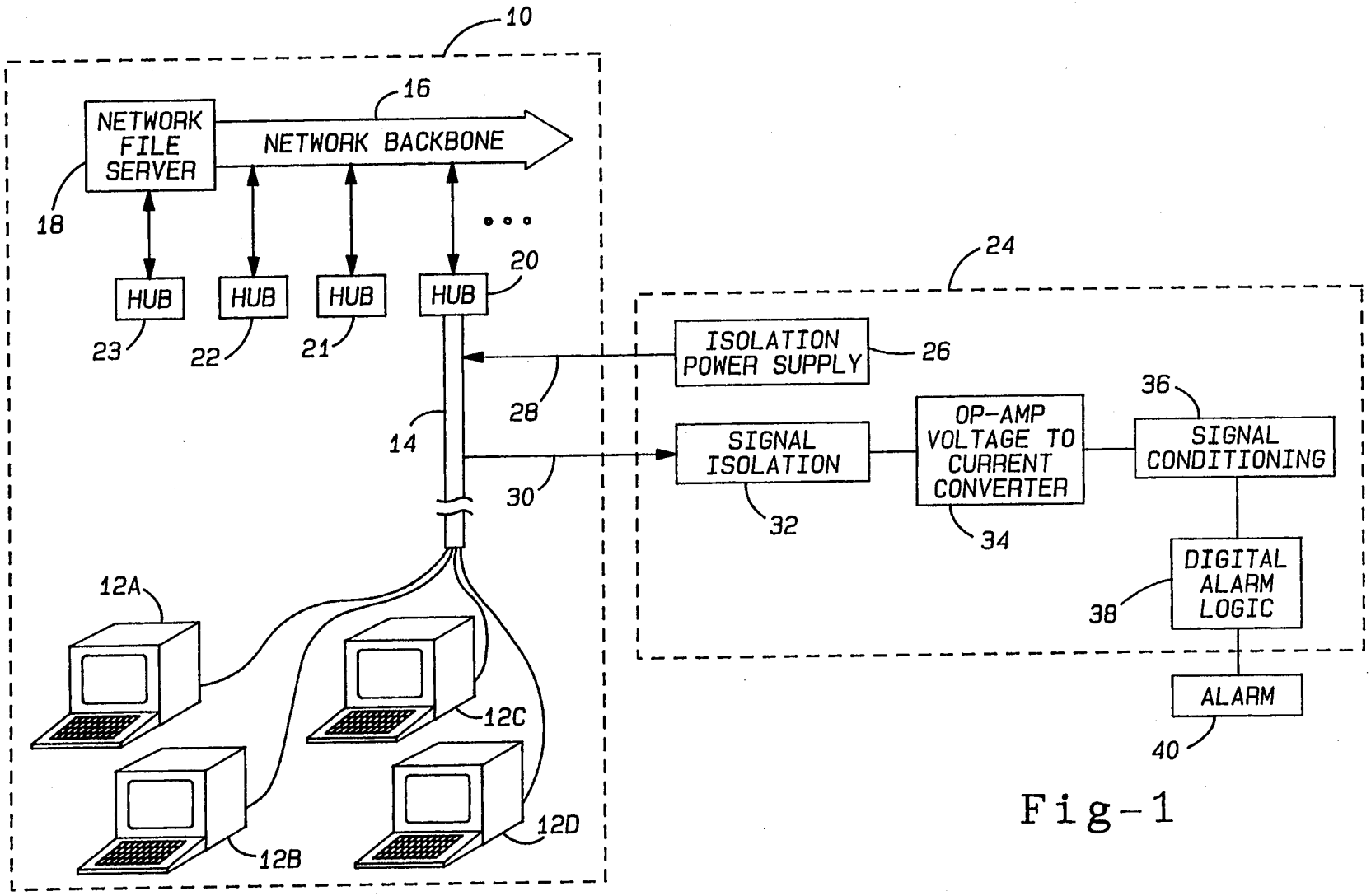
FIG. 1 is a block diagram which illustrates a network security system coupled in to a computer network in accordance with the present invention.
Figure 2:
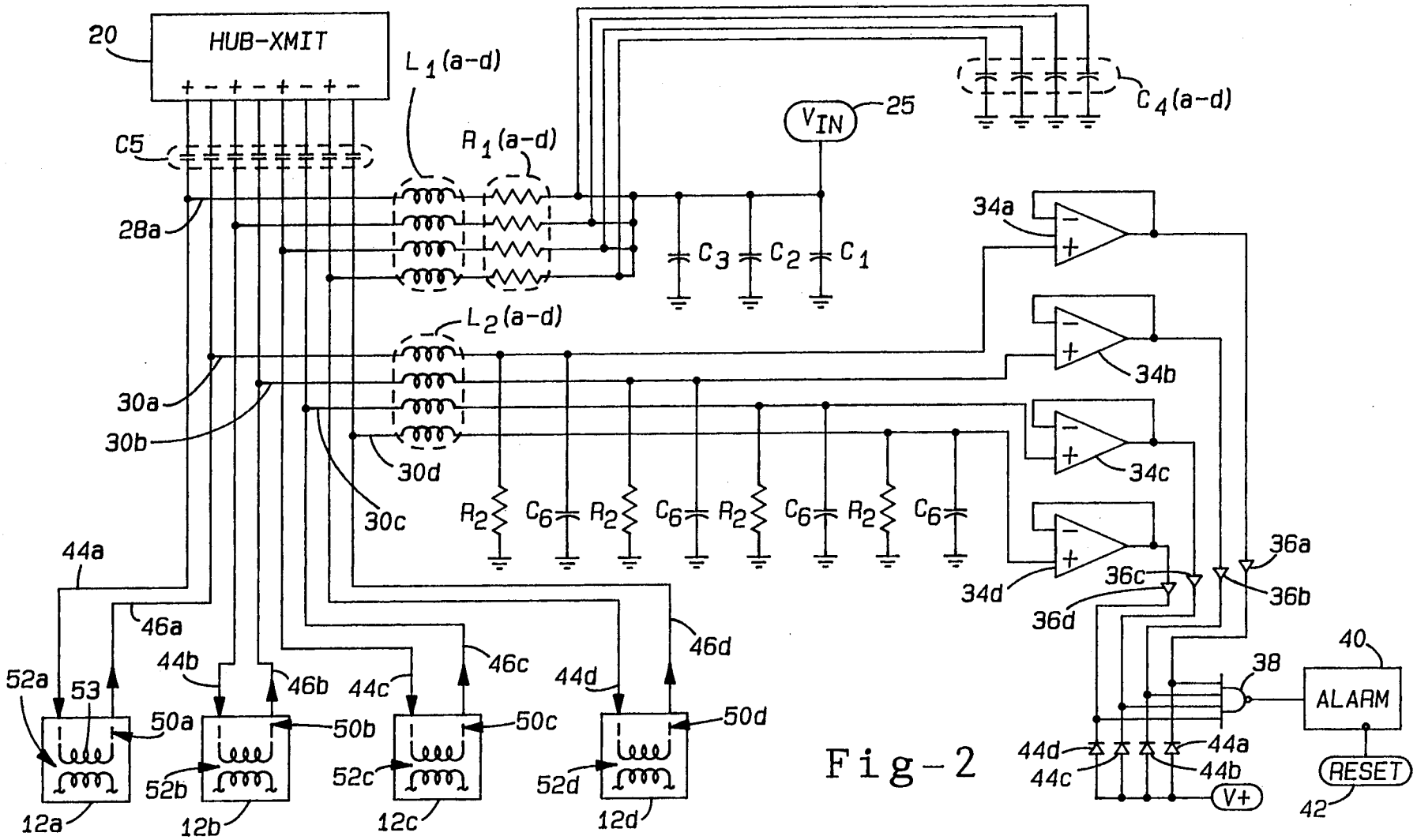
FIG. 2 is a circuit diagram which illustrates the network security system coupled to the computer network in accordance with the present invention.

Turning now to FIGS. 1 and 2 a network security system 24 is provided therein for achieving theft protection of electronic computer equipment associated with a computer network 10. In general, the network security system 24 monitors remotely located electronic work stations such as personal computers 12*a* through 12*d* via current loop continuity so as to detect the removal of any of the personal computers 12*a* through 12*d* from the computer network 10. The network security system 24 described herein is particularly adapted to be easily implemented in conjunction with an existing computer network 10 without the need for substantial modifications and while realizing minimal interference to the computer network 10.

Remotely located personal computers 12*a* through 12*d* are each connected to the computer network 10 so as to provide widespread remote user access to the computer network 10. The computer network 10 shown herein is of the conventional type which includes a network file server 18 connected to a network backbone 16. The computer network 10 may include most any type of backbone such as, for instance, an Ethernet® backbone manufactured by Xerox Corporation. A plurality of hubs such as hubs 20, 21, 22 and 23 are generally coupled to the network file server 18 or backbone 16 to provide communication links therewith. The remotely located personal computers 12*a* through 12*d* are shown connected to hub 20 via a data communication link 14. Data communication link 14 includes a plurality of transmit and receive data communication lines for communicating information between each of remotely located personal computers 12*a* through 12*d* and the network file server 18 via network backbone 16 and hub 20.

The invention described herein is particularly suited to be implemented in conjunction with a computer network 10 which preferably employs a conventional wiring approach of the type which may include 10BaseT wiring. Wiring schemes of the 10BaseT type are commonly employed to provide data communication lines for electronic computer equipment. In accordance with conventional wiring approaches, data communication link 14 generally includes a plurality of pairs of transmit wires 44 and 46 as well as a plurality of pairs of receive wires (not shown) connected to each of personal computers 12*a* through 12*d*. Each pair of transmit wires 44 and 46 are internally coupled to an associated personal computer 12 via one winding 53 of an internally located isolation transformer 52. Each pair of transmit wires 44 and 46 along with isolation transformer 52 thereby form a current loop 50 through the personal computer 12 which is advantageously employed in accordance with the approach described herein. However, the same approach could be implemented with the pairs of receive wires without departing from the scope of this invention.

The network security system 24 includes an isolation power supply 26 which supplies a continuous direct current (DC) power signal to each of current loops 50*a* through 50*d*. The DC power signal has a low current preferably on the order of magnitude of less than one milliamp (1 mA) and, more specifically includes a preferred current of approximately fifty microamps (50 μA). The isolation power supply 26 includes an input terminal 25 for receiving a low voltage signal $V_{IN}$. which has a magnitude of approximately five (5) volts. A plurality of parallel connected capacitors $C_1$, $C_2$, and $C_3$ are connected to input terminal 25. In addition, a plurality of power supply lines 28*a* through 28*d* are provided, each of which has one of capacitors $C_4$(a–d) coupled thereto, and all of which are coupled to parallel connected capacitors $C_1$ through $C_3$. Capacitors $C_1$ through $C_4$ operate as a power supply filter to filter out any undesirable AC signals such as network operating signals. Each of power supply lines 28*a* through 28*d* is further coupled in series to one of resistors $R_1$(a–d) and one of inductors $L_1$(a–d), respectively. Each of resistors $R_1$(a–d) has a preferred resistance of about one kiloohm (1 kΩ) which ensures a low current flow thereacross. Accordingly, inductors $L_1$(a–d) provide isolation to power supply 26 by blocking unwanted AC signals from transmitting through lines 28*a* through 28*d*. According to one embodiment, capacitors $C_1$ through $C_3$ have respective values of 100 pF, 0.1 μF and 1.0 μF, while capacitors $C_4$(a–d) each have values of 0.1 μF and inductors $L_1$(a–d) each have values of 120 mH.

The power supply lines 28*a* through 28*d* each are electrically coupled to respective transmit wires 44*a* through 44*d* found within data communication link 14. Receive power lines 30*a* through 30*d* are likewise electrically coupled to transmit wires 46*a* through 46*d* also found within the data communication link 14. Transmit wires 44*a* through 44*d* and 46*a* through 46*d* are existing wires found within data communication link 14 that are selectively tapped as pairs in accordance with the present invention to provide current loops 50*a* through 50*d*.

As a consequence, power supply line 28*a* continuously supplies a low current DC power signal to remote personal computer 12*a* via transmit wire 44*a*. The low current power signal flows through an internal path provided by existing circuitry in personal computer 12*a*. The low current power signal then exits the remote personal computer 12*a* via transmit wire 46*a* and in turn is picked up by receive power line 30*a*. The low current power signal is continuously supplied to current loops 50*a* through 50*d* at all times regardless of whether the computer network 10 or any personal computers 12*a* through 12*d* are operating or not. In addition, the very low current DC power signal is so small that it does not interfere with or adversely effect the operation of the associated computers 12*a* through 12*d* or computer network 10. To prevent the flow of DC current to or from hub 20, each of transmit wires 44*a* through 44*d* and 46*a* through 46*d* are further coupled to DC blocking capacitors $C_5$ between each of current loops 50*a* through 50*d* and hub 20. DC blocking capacitors $C_5$ thereby prevent unwanted DC current paths through hub 20.

The return power signals tapped from transmit wires 46*a* through 46*d* via receive power lines 30*a* through 30*d* are then applied to a signal isolation device 32. The signal isolation device 32 includes an RLC circuit made up of inductors $L_2$(a–d) coupled in parallel to grounded pairs of parallel connected resistors $R_2$ and capacitors $C_6$ which are coupled to each of receive power lines 30*a* through 30*d*. Accordingly, the signal isolation device 32 helps to prevent network operating signals from interfering with one another. According to one preferred embodiment, resistors $R_2$ and capacitors $C_6$ each have preferred values of 100 kΩ and 0.33 μF, respectively, while inductors $L_2$(a–d) each have preferred values of 120 mH each.

Op-amp voltage to current converters 34*a* through 34*d* are further connected to receive power lines 30*a* through 30*d*, respectively. The voltage to current converters 34A through 34D each convert the return power signal to a desired magnitude current signal via an operational transconductance amplifier. A signal conditioning unit 36 in turn is connected to the output of the voltage to current converter 34. The signal conditioning unit 36 includes Schmidt trigger buffers 36*a* through 36*d* which further ensure a smooth DC signal response.

The signal conditioning unit 36 has an output connected to digital alarm logic 38 which essentially includes a NAND gate 38. The NAND gate 38 has four inputs for receiving a signal from each of receive power lines 30(a–d) and generates a NAND logic operation in response thereto. The output of the NAND gate 38 in turn provides an alarm output signal to an alarm 40. Accordingly, a "high" signal on each NAND gate input which is indicative of unbroken current loop continuity will result in a "low" alarm output signal. Whereas, a "low" signal on any input which is indicative of a current loop discontinuity will result in a "high" alarm output signal. The alarm 40 includes a reset 42 for disabling the alarm 40 when so desired. In addition, the alarm output signal may be further used to activate the operation of additional security related functions which may include alarm status notification to designated authorities via a telephone link amongst other possible functions known throughout the field.

In addition, each of receive power lines 30*a* through 30*d* is further coupled to one end of light emitting diodes 48*a* through 48*d*. The other end of light emitting diodes 48*a* through 48*d* are coupled to a voltage power supply V+. As a consequence, each of light emitting diodes 48*a* through 48*d* provides an energized light indication whenever the associated current loop 50 is broken so as to indicate which of the personal computers 12*a* through 12*d* are disconnected from the computer network 10.

Figure 3:
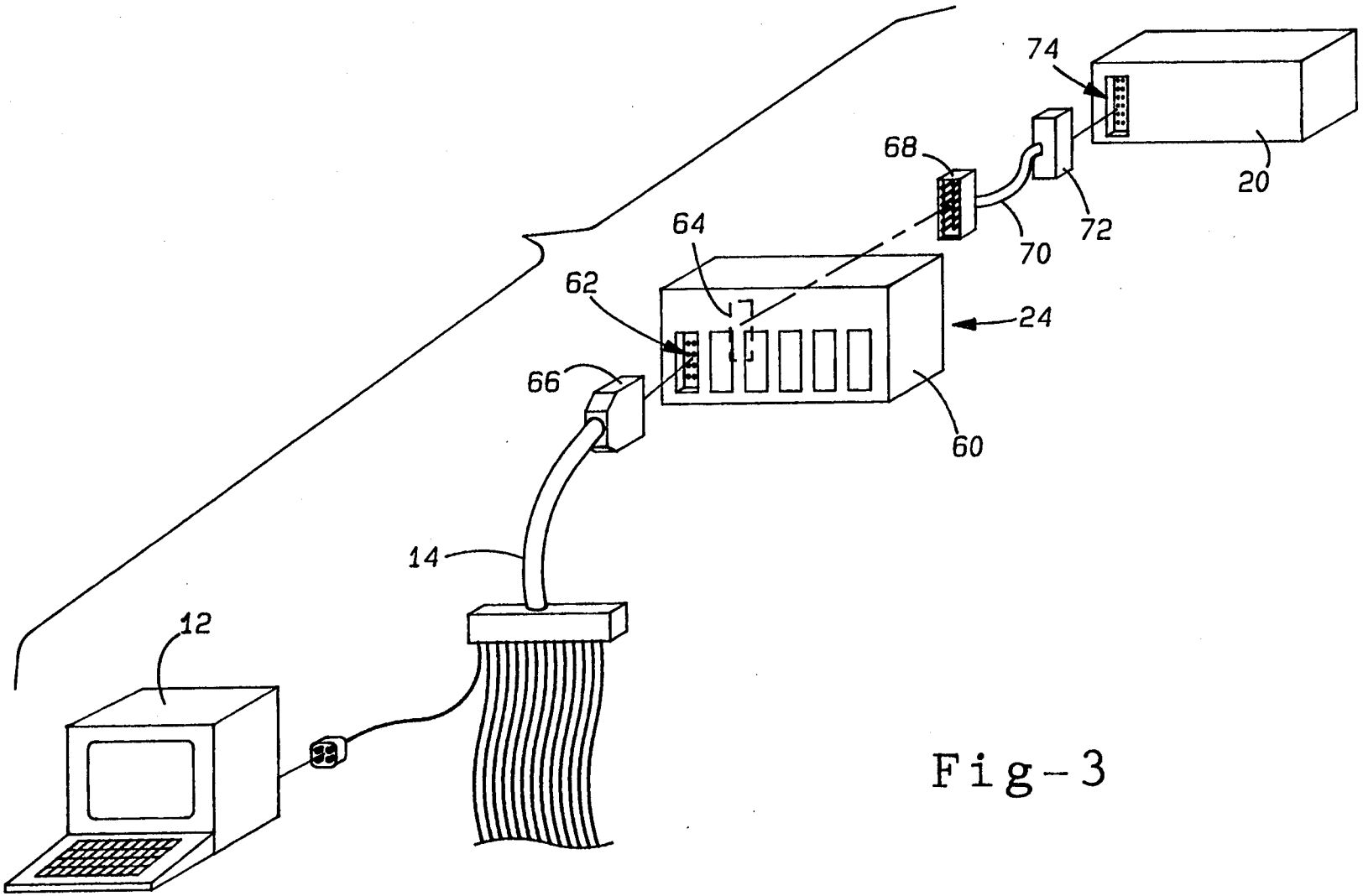
FIG. 3 is a schematic diagram which illustrates installation of the network security system into an existing computer network in accordance with the present invention.

FIG. 3 illustrates the connection of the network security system 24 to an existing computer network 10. The network security system 24 is substantially enclosed within a housing 60 which is connected between data communication link 14 and hub 20. The housing 60 has one or more female receptacles 62 each for receiving a male plug 66 that is connected to one end of the data communication link 14. The housing 60 further includes one or more additional female receptacles 64 for receiving a male plug 68 from an additional data communication extension line 70 which in turn connects to female receptacle 74 in hub 20 via male plug 72. For purposes of maintaining a secure system, the network security system 24 is preferably located in a secure area separate from personal computers 12*a* through 12*d*. This further ensures against unwanted tampering with the network security system 24.

To implement the present invention, the network security system 24 is easily installed into an existing computer network 10 such as that employing a 10BaseT hub to workstation communication link 14. In doing so, the housing 60 enclosing the network security system 24 is connected between data communication link 14 and hub 20 so that male plug 66 is removed from female receptacle 74 in hub 20 and inserted into female receptacle 62 in housing 60. The additional data communication extension link 70 is in turn connected between housing 60 and hub 20. As a consequence, power supply lines 28*a* through 28*d* and receive power lines 30*a* through 30*d* are easily tapped into selected pairs of existing transmit wires 44(a–d) and 46(a–d) found in data communication link 14. The selected pairs of transmit wires 44 and 46 enable current to flow through current loops 50*a* through 50*d* internally coupled to personal computers 12*a* through 12*d*, respectively.

In operation, the isolation power supply 26 supplies a continuous low current DC power signal to each of power supply lines 28*a* through 28*d*. The low current power signal flows through current loops 50*a* through 50*d* via pairs of transmit wires 44 and 46 and existing circuitry such as isolation transformers 52 within each of the remote personal computers 12*a* through 12*d* being monitored. The return signal in each of current loops 50*a* through 50*d* is applied to a signal isolation device 32 for preventing signal interference among the separate communication channels and then is further coupled to an op-amp voltage to current converter 34. Voltage to current converter 34 converts the voltage to a desired current level which in turn is applied to a logic NAND gate 38. The logic NAND gate 38 detects discontinuities in the current loops 50*a* through 50*d* being monitored and provides an output indication to an alarm 40 which indicates removal of one or more of remote personal computers 12*a* through 12*d* from the computer network 10. In addition, detection of a current flow discontinuity further energizes the appropriate light emitting diodes 44*a* through 44*d* associated with the disconnected personal computer 12.

While this invention has been described herein in connection with a network security system 24 for detecting continued connection of remotely located personal computers 12*a* through 12*d* to a computer network 10, it is conceivable that other electronic equipment may likewise be detected without departing from the spirit of this invention. In addition, any number of pieces of equipment may be monitored with the network security system 24 and any number of network security systems may be coupled to a given network or a plurality of networks to handle large numbers of remotely located pieces of equipment.

In view of the foregoing, it can be appreciated that the present invention enables the user to achieve anti-theft protection for remotely located electronic equipment connected to an existing network system. Thus, while this invention has been disclosed herein in combination with a particular example thereof, no limitation is intended thereby except as defined in the following claims. This is because a skilled practitioner recognizes that other modifications can be made without departing from the spirit of this invention after studying the specification and drawings.

What is claimed is:

1. A security system for detecting disconnection of electronic equipment from a network, said security system comprising:

current loop means including separate current loops associated with different pieces of monitored equipment, each of said current loops employing a pair of data communication lines which connect one of the associated pieces of equipment to the network and which are coupled to existing internal circuitry within the associated piece of monitored equipment, and wherein respective pairs of data communication lines are associated with different ones of the associated pieces of equipment;

source means for supplying a low DC current signal to each of said current loops; and detector means for monitoring the current signal through each of said current loops and detecting a change in said current signal through one of said current loops which represents disconnection of said associated piece of equipment from the network.

2. The security system as defined in claim 1 wherein said electronic equipment comprises computer workstations each connected to a network file server and located remote from the network file server.

3. The security system as defined in claim 1 wherein each of said current loops includes existing pairs of data communication lines used by said network for communicating data between the associated pieces of equipment and a network file server.

4. The security system as defined in claim 1 wherein said network includes an Ethernet® network and said respective pairs of data communication lines include existing 10BaseT wiring connecting the different ones of the associated pieces of equipment to said network.

5. The security system as defined in claim 1 wherein said existing internal circuitry includes an isolation transformer having a first winding coupled between said pair of data communication lines so as to allow said current signal to flow therethrough when the associated piece of equipment is connected to the network.

6. The security system as defined in claim 1 wherein said system further comprises high frequency filter means coupled to each of said current loops for providing isolation to each of said current loops.

7. The security system as defined in claim 1 further comprising DC blocking capacitors coupled to each of said current loops for preventing said current signal through one of said current loops from interfering with other of said current loops.

8. The security system as defined in claim 1 further comprising alarm indicator means responsive to said current detection for providing an alarm signal indicative of a disconnected piece of said equipment when said change in the current signal through one of said current loops is detected.

9. A security system for detecting unauthorized disconnection of electronic equipment that is connected to a network communication link having existing pairs of data communication lines interconnecting said electronic equipment to a network, said system comprising:

current loop means including separate current loops associated with different pieces of protected equipment and internally coupled to the associated pieces of protected equipment, each of said current loops using said existing pair of data communication lines which are coupled together via existing internal circuitry within said associated equipment to form a complete circuit path therethrough, and wherein respective pairs of data communication lines are associated with different ones of the associated pieces of equipment;

source means for supplying a low DC current signal to each of said current loops;

sensing means for sensing current flow through each of said current loops and detecting a change in said current flow through one of said current loops which is indicative of disconnection of one of the associated pieces of equipment; and output means for providing an alarm output signal so as to indicate detection of a disconnected one of said pieces of equipment.

10. The security system as defined in claim 9 wherein each of said pairs of data communication lines are coupled between one of said associated pieces of equipment and a network file server.

11. The security system as defined in claim 9 wherein said data communication lines are provided via 10BaseT wiring.

12. The security system as defined in claim 9 wherein said internal circuitry within said associated equipment comprises a first winding of a transformer which is coupled between each of said respective pairs of data communication lines to form a circuit path through each of said pairs of data communication lines.

13. The security system as defined in claim 9 wherein said DC current signal has a current of less than 1 milliamp.

14. A method for detecting unauthorized disconnection of remotely located electronic equipment which has existing data communication lines connecting the equipment to a network, said method comprising:

selecting respective pairs of the existing data communication lines for associated pieces of monitored equipment so that each of said selected pairs of data communication lines forms a current loop through the associated pieces of monitored equipment, wherein said respective pairs of data communication lines are associated with different ones of the associated pieces of equipment;

supplying a low DC current signal to each current loop so as to achieve continuous current flow through each current loop while each of said associated pieces of equipment is physically connected to said network via the data communication lines; and sensing said DC current signal in each of said current loops so as to detect a change in current flow indicative of disconnection of one of said pieces of associated equipment.

15. The method as defined in claim 14 further comprising the step of providing an alarm signal when said disconnection of one of said pieces of equipment is detected.

16. The method as defined in claim 14 further comprising the step of:

selectively tapping into each of said selected pairs of existing data communication lines at a location which is remote from said associated pieces of equipment.

17. The method as defined in claim 14 wherein said existing data communication lines comprise 10BaseT wiring.

18. The method as defined in claim 14 wherein each of said pieces of electronic equipment comprises a computer workstation connected to an Ethernet® network.

19. The method as defined in claim 14 wherein each of said current loops includes existing circuitry within the associated piece of equipment and coupled between the one of said associated pairs of data communication lines to provide a circuit path therebetween.

* * * * *